US007247064B2

(12) United States Patent
Nakamura

(10) Patent No.: US 7,247,064 B2
(45) Date of Patent: Jul. 24, 2007

(54) COWLING ASSEMBLY FOR OUTBOARD MOTOR

(75) Inventor: Daisuke Nakamura, Hamamatsu (JP)

(73) Assignee: Yamaha Marine Kabushiki Kaisha, Hamamatsu-Shi, Shizuoka-Ken (JP)

( * ) Notice: Subject to any disclaimer, the term of this patent is extended or adjusted under 35 U.S.C. 154(b) by 0 days.

(21) Appl. No.: 11/047,516

(22) Filed: Jan. 31, 2005

(65) Prior Publication Data

US 2005/0186863 A1 Aug. 25, 2005

(30) Foreign Application Priority Data

Jan. 30, 2004 (JP) ..... 2004-024921

(51) Int. Cl.
*B63H 20/32* (2006.01)
*B63H 21/36* (2006.01)

(52) U.S. Cl. ..... 440/77

(58) Field of Classification Search ..... 440/77
See application file for complete search history.

(56) References Cited

U.S. PATENT DOCUMENTS 3,172,927 A * 3/1965 Mojonnier ..... 264/550
3,414,941 A * 12/1968 Ignell ..... 425/310
4,930,790 A * 6/1990 Sheridan ..... 277/630
5,052,353 A * 10/1991 Dunham et al. ..... 123/195 P
5,120,248 A * 6/1992 Daleiden et al. ..... 440/77
5,302,147 A * 4/1994 Oishi ..... 440/77

FOREIGN PATENT DOCUMENTS

JP 2002-349257 4/2002

* cited by examiner

*Primary Examiner*—Sherman Basinger
(74) *Attorney, Agent, or Firm*—Knobbe, Martens, Olson & Bear, LLP

(57) ABSTRACT

A cowling assembly for an outboard motor includes a top cowling and a bottom cowling for covering an internal combustion engine for an outboard motor. The top cowling is formed by pressing a nonferrous material. The top cowling includes an opening edge and attaching surfaces of an annular rail are secured to an inner side of the opening edge of the top cowling thereby reinforcing the opening edge and enhancing its mounting strength. Furthermore, a seal formed along an opening edge of the bottom cowling and the opening edge and annular rail of the top cowling provides enhanced sealing by extending the sealing surfaces in different directions.

10 Claims, 12 Drawing Sheets

COWLING ASSEMBLY FOR OUTBOARD MOTOR

PRIORITY INFORMATION

The present application is based on and claims priority under 35 U.S.C. §119 to Japanese Patent Application No. 2004-024921, filed on Jan. 30, 2004, the entire contents of which are expressly incorporated by reference herein.

BACKGROUND OF THE INVENTION

1. Field of the Invention

The present invention relates generally to a cowling assembly for covering an internal combustion engine of an outboard motor, and more particularly relates to an improved cowling assembly having top and bottom cowlings, wherein an opening edge of the top cowling is reinforced with an annular rail.

2. Description of the Related Art

Conventionally, outboard motors include internal combustion engines covered with top and bottom cowlings. The top and bottom cowlings often attach to one another by engaging bottom-side hooks attached to the opening edge of the bottom cowling and top-side hooks attached to the opening edge of the top cowling. For example, Japanese patent JP2002349257A2, entitled OUTBOARD MOTOR, discloses such an arrangement.

SUMMARY OF THE INVENTION

An aspect of at least one invention described herein includes the realization that when mounting bosses, such as those used for securing the connecting hooks for top cowling members are formed integrally with the top cowling by molding, the top cowling can be excessively thick in some areas. The top cowling is thus heavier, especially when the top cowling is made of a reinforced resin, as is frequently the case. To address such a need, an aspect of at least one invention described herein involves providing a cowling assembly with a top cowling formed of lighter weight material such that the top cowling is strong enough to support hook mounting bosses for securing the top-side hooks and further is strong enough around an opening edge of the top cowling to suitably engage and seal with the bottom cowling.

Thus, in accordance with an embodiment, a cowling assembly for an outboard motor, comprising a top cowling and a bottom cowling for covering an internal combustion engine of the outboard motor is provided. The top cowling is formed by pressing a nonferrous material. Additionally, the top cowling comprises an annular rail secured to an inner side of an opening edge of the top cowling.

BRIEF DESCRIPTION OF THE DRAWINGS

These and other features, aspects, and advantages of the present invention are described below with reference to the drawings of preferred embodiments, which embodiments are intended to illustrate and not to limit the present invention.

DETAILED DESCRIPTION OF THE PREFERRED EMBODIMENT

FIGS. 1–12 illustrate a cowling assembly 7 for an outboard motor 1 configured in accordance with certain features, aspects, and advantages of at least one invention described herein. The outboard motor 1 merely exemplifies one type of outboard drive. However, the various cowling assemblies disclosed herein can be used with other types of devices that benefit from cowling types of enclosures. Such applications will be apparent to those of ordinary skill in the art in view of the description herein. These inventions are not limited to the embodiments described, which include the preferred embodiments, and the terminology used herein is not intended to limit the scope of the present inventions.

Figure 1:
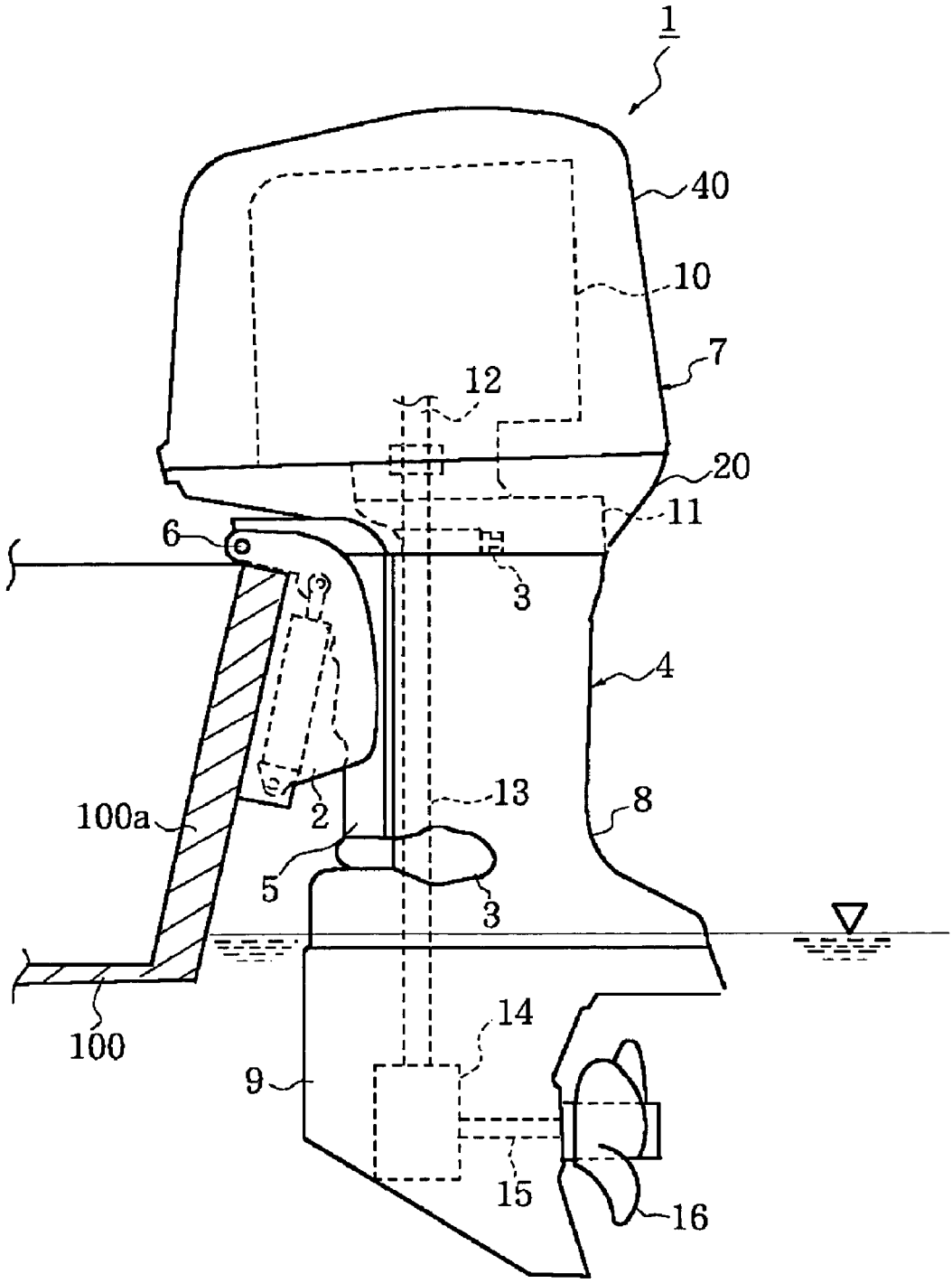
FIG. 1 is a side view of one embodiment of an outboard motor, having top and bottom cowling members and with certain internal components illustrated in phantom line.

The general structure of an outboard motor is described with reference to FIG. 1. As depicted in FIG. 1, an outboard motor 1 is attached to a stem plate 100*a* of a hull 100 of a boat or other watercraft by a clamp bracket 2. A swivel bracket 5, having upper and lower damper members 3 for elastically supporting a propulsion unit 4, is supported for vertical rotation by a cramp bracket 2 via a tilt shaft 6.

The propulsion unit 4 has a housing comprising a cowling assembly 7, an upper case 8, and a lower case 9. An internal combustion engine 10, such as, for example, a four-cycle internal combustion engine, can be housed in the cowling assembly 7. However, other engines can also be used. In various embodiments, the upper case 8 is attached to a lower part of an exhaust guide plate 11. The internal combustion engine 10 can be supported on the exhaust guide 11 plate.

As depicted in FIG. 1, the internal combustion engine 10 has a crankshaft 12 extending vertically and connected to an upper end of a drive shaft 13, which extends vertically through the upper case 8. A lower end of the drive shaft 13 is connected to a forward/reverse switching mechanism 14 housed in the lower case 9. A propeller shaft 15 extends horizontally from the forward/reverse switching mechanism 14 and has a rear end, which protrudes outside of the lower case 9, and to which a propeller 16 is attached.

The cowling assembly 7 can comprise a bottom cowling member 20 and a top cowling member 40 that, in various embodiments, attach to one another, described in greater detail below with reference to FIG. 2 to FIG. 10.

Figure 2:
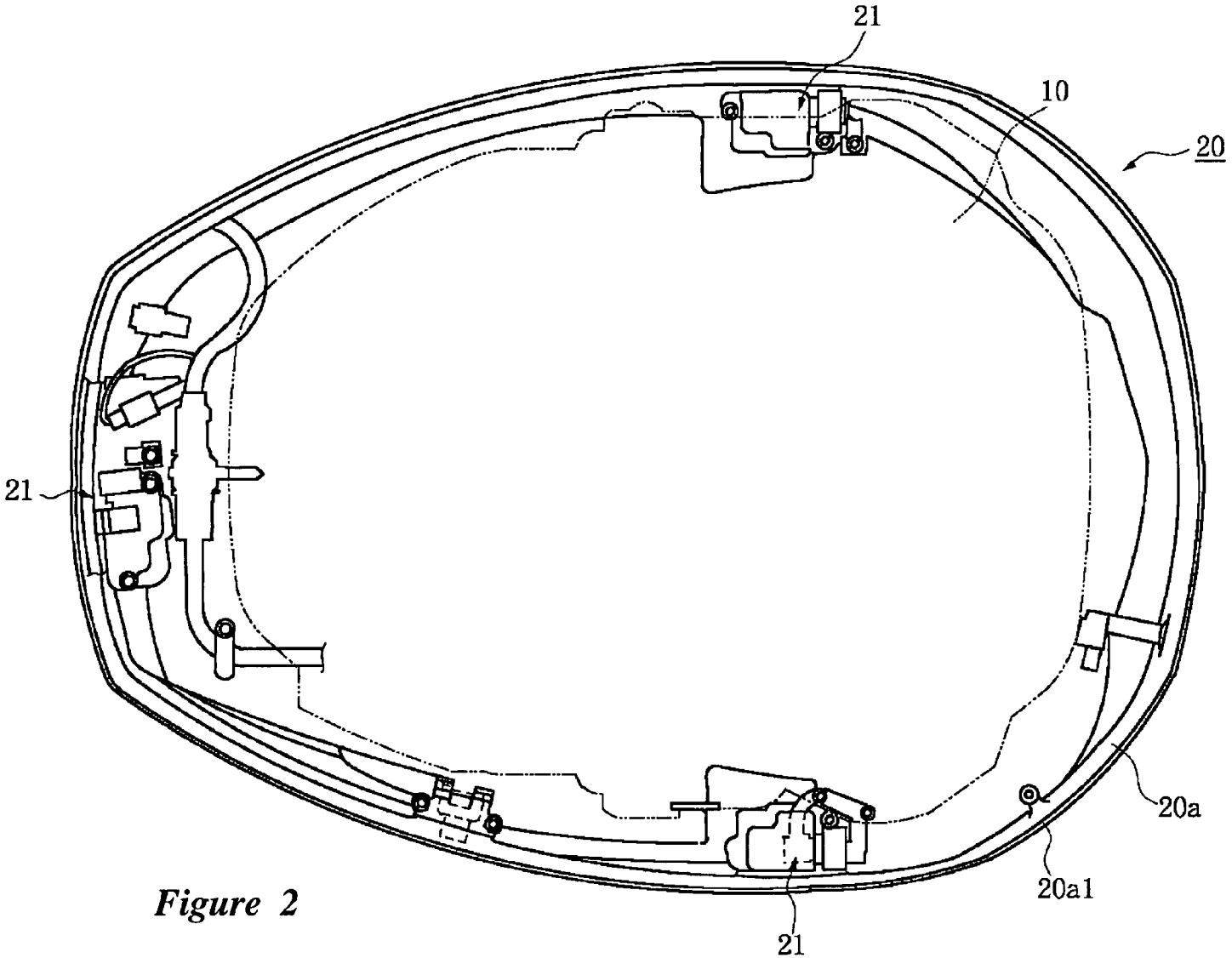
FIG. 2 is a top plan view of the outboard motor of FIG. 1 with a top cowling member removed and an engine illustrated in phantom line.

FIG. 2 is a plan view of one embodiment of the bottom cowling 20, with the internal combustion engine 10 illustrated in phantom line. The bottom cowling 20 can be made of an aluminum material by die-casting, or any other method.

Figure 7:
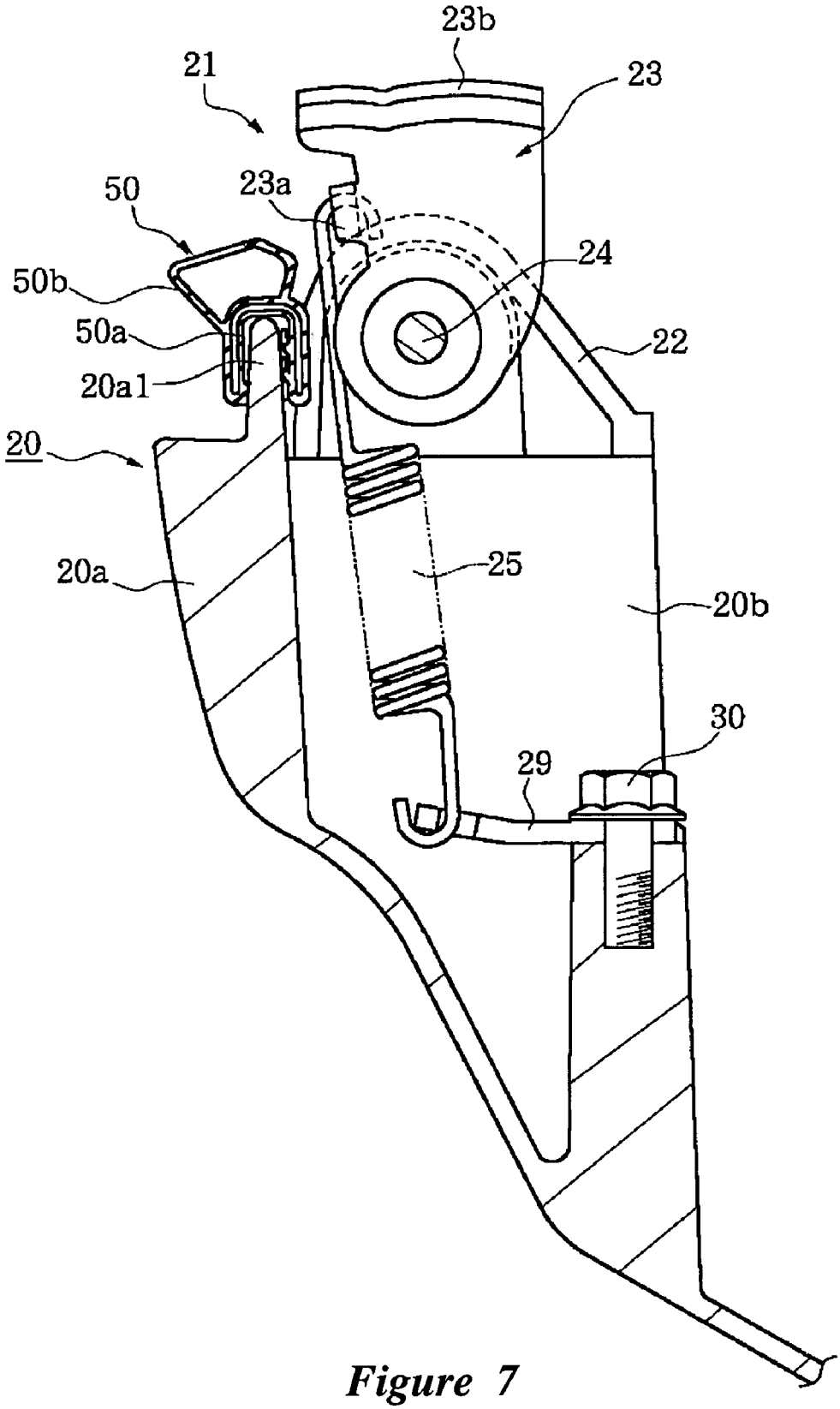
FIG. 7 is a cross-sectional view of FIG. 5 taken along the VII—VII line.

The bottom cowling 20 has an opening edge 20*a*, from which a rib 20*a* 1 extends upwards, also shown in another perspective in FIG. 7. The rib 20*a* 1 can be configured to form a seal between the bottom cowling 20 and the top cowling 40, also described below with reference to FIG. 10.

Bottom-side attachment assemblies 21 can be provided at a plurality of positions along the opening edge 20*a* of the bottom cowling 20. For example, in the embodiment depicted in FIG. 2, bottom-side attachment assemblies 21 are provided at three positions along the opening edge 20*a* of the bottom cowling 20, namely, at a position that faces the hull 100 and at positions on the port and starboard sides of the bottom cowling 20.

Figure 5:
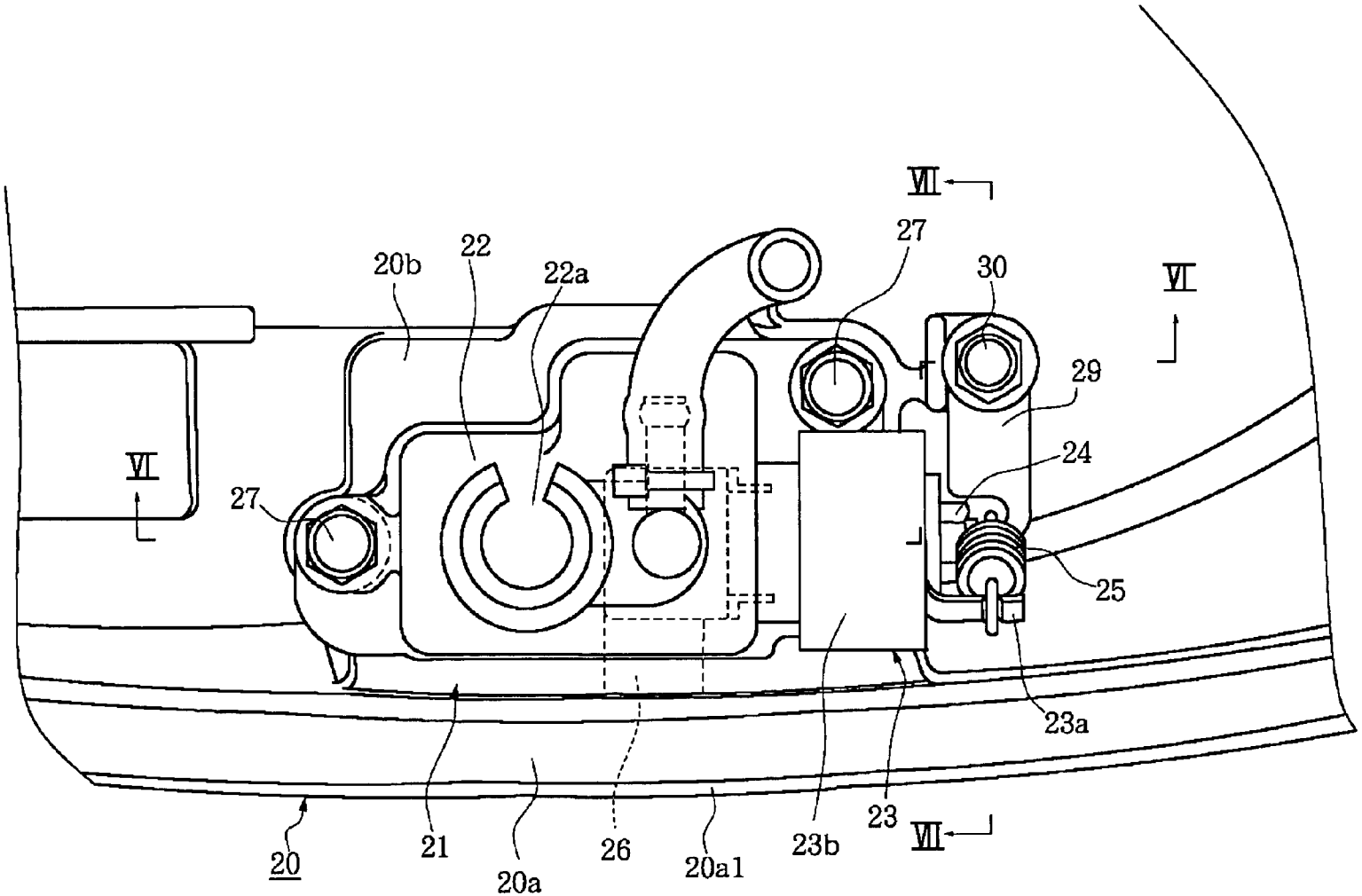
FIG. 5 is an enlarged top plan view of a bottom-side attaching part connected to the bottom cowling member.
Figure 6:
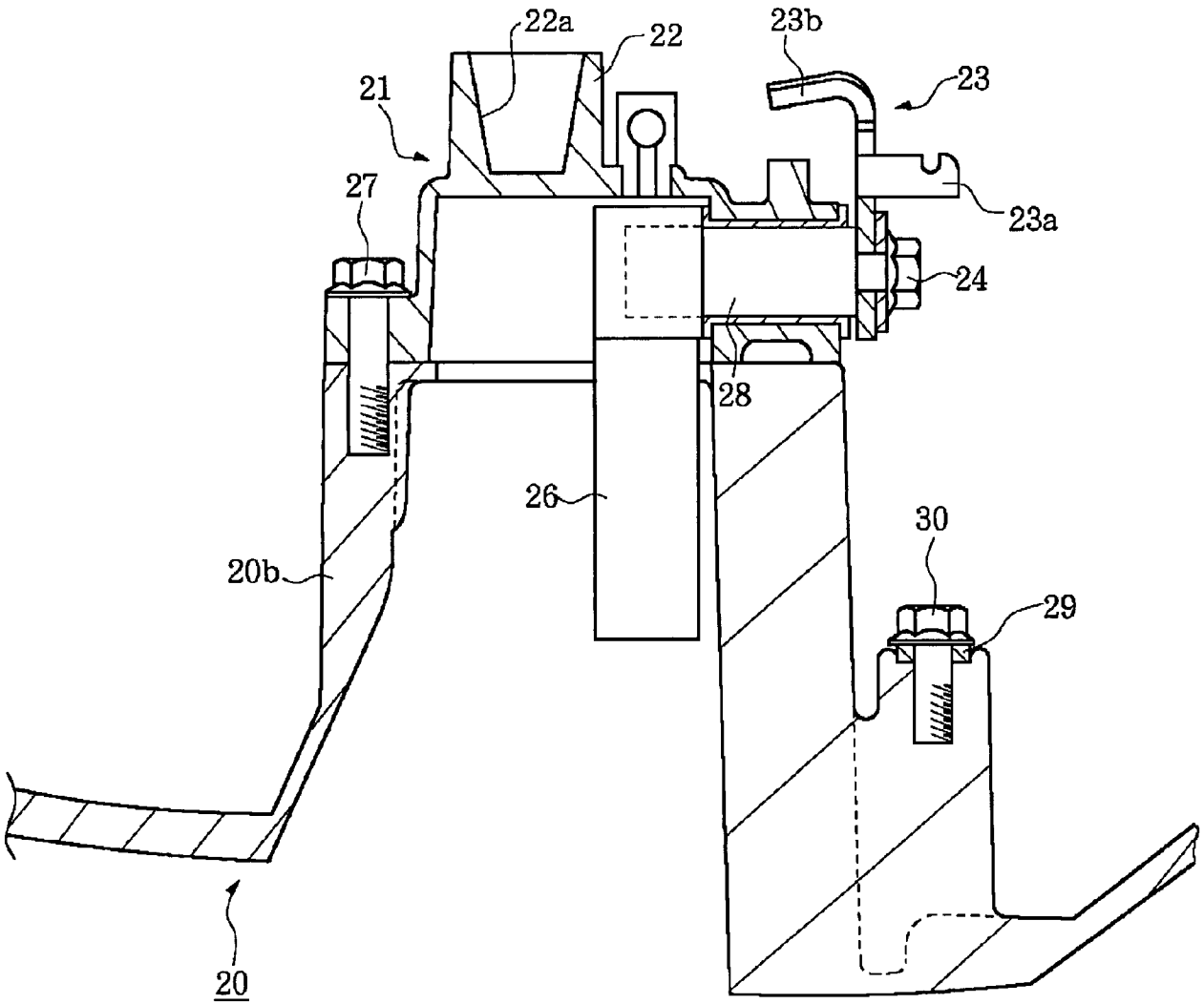
FIG. 6 is a cross-sectional view of FIG. 5 taken along the VI—VI line.

FIG. 5 is a plan view of one embodiment of a bottom-side attaching part, and FIGS. 6 and 7 are cross-sectional views of FIG. 5, taken along the lines VI—VI and VII—VII, respectively. Each of the bottom-side attachment assemblies 21 comprises a supporting holder 22, a bottom-side hook 23, a mounting bolt 24, a spring 25, and a lever 26. The supporting holder 22 is secured to a mounting boss 20*b* extending inward from the opening edge 20*a* of the bottom cowling 20 by mounting bolts 27. The bottom-side hook 23 is attached, by the mounting bolt 24, to a supporting shaft 28 rotatably supported by the supporting holder 22. A stay 29 is attached to the mounting boss 20*b* by a mounting bolt 30, and the spring 25 is provided between the stay 29 and a supporting part 23*a* of the bottom-side hook 23. The spring 25 is urged in a direction to raise an engaging part 23*b* of the bottom-side hook 23 that is attached to the opening edge 20*a* of the bottom cowling 20. The supporting holder 22 has a positioning recess 22*a*. As depicted in FIG. 7, the bottom cowling 20 further comprises a seal member 50, which includes an engaging part 50*a* and a seal part 50*b*, and whose function will be described in greater detail with respect to the attachment of the top cowling 40 and the bottom cowling 20.

Figure 3:
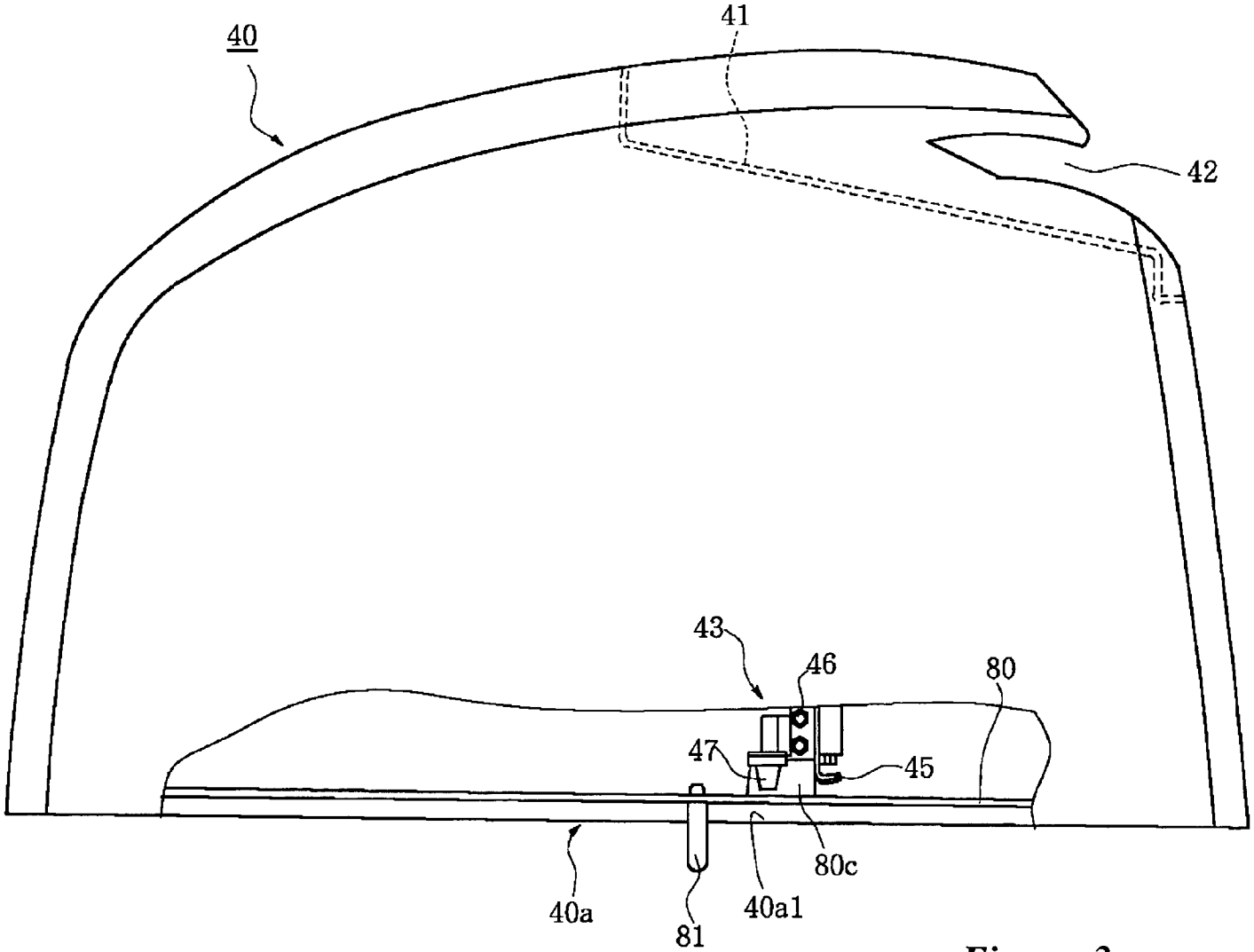
FIG. 3 is a side elevational and partial cut-away view of the top cowling member of FIG. 1 removed from the outboard motor, and illustrating a top-side attaching part of the top cowling member.
Figure 4:
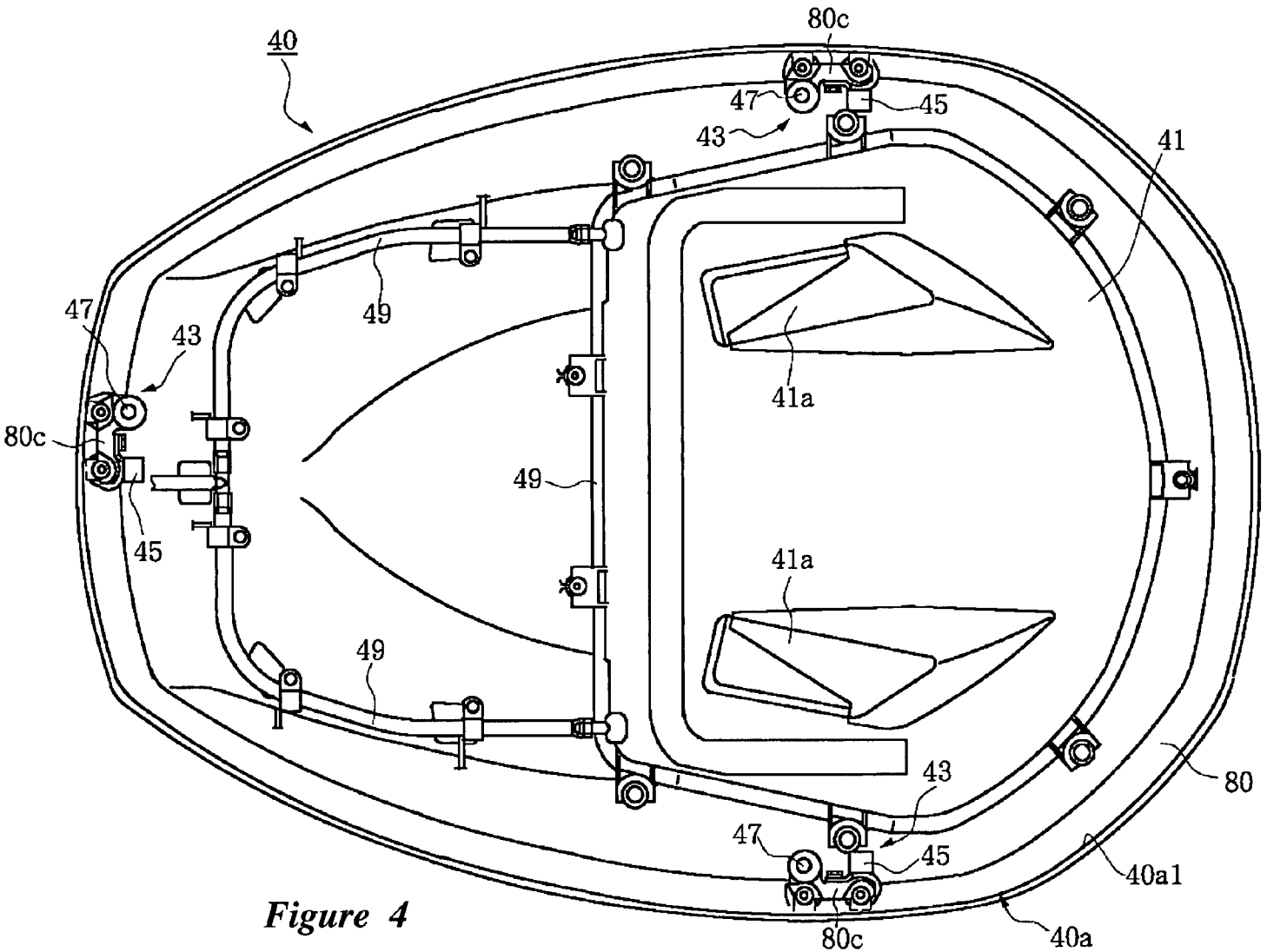
FIG. 4 is a bottom plan view of the top cowling member removed from the outboard motor.

FIGS. 3 and 4 provide two views of an embodiment of a top cowling 40. FIG. 3 is a side view of the top cowling member 40, from which an exterior part is cut away to reveal a top-side attachment assembly 43 inside the top cowling member 40. The top-side attachment assembly 43 is described in greater detail below.

FIG. 4 is bottom plan view of one embodiment of the top cowling 40. The top cowling 40 can be provided with a baffle plate 41 covering an intake opening 42 of the top cowling 40. The baffle plate 41 can include a pair of right and left air intake openings 41*a*. Air introduced through the intake opening 42 and sucked through the air intake openings 41*a* can be used to cool the engine 10. The air can also be sucked through an air cleaner (not shown) and then into the engine 10 for combustion therein. Water drops separated by the baffle plate 41 are collected into a discharge hose 49 and can be discharged so as not to fall onto the engine 10.

In various embodiments, the top cowling 40 can made by pressing a nonferrous material into a desired shape. For example, the top cowling 40 can be formed by pressing a plate of a aluminum or magnesium. However, other materials can also be used.

As further depicted in FIGS. 3 and 4, the top cowling 40 has an opening edge 40*a*. The opening edge 40*a* of the top cowling 40 has an inner side 40*a* 1, to which an annular rail 80 can be secured. In a preferred embodiment, the annular rail 80 is formed by curving an elongated metal strip into a shape which fits the inner periphery of the opening edge 40*a*. Optionally, the annular rail 80 can be formed by stamping a large metal plate material into a shape which fits the inner periphery of the opening edge 40*a*. The annular rail 80 has an extended portion extending generally horizontally inward from the opening edge 40*a* of the top cowling 40.

In various embodiments, top-side attachment assemblies 43 can be provided at a plurality of positions on the annular rail 80. In a preferred embodiment, depicted in FIG. 4, top-side attachment assemblies 43 are provided at three positions on the annular rail 80, namely, on a side of the top cowling 40 that faces the hull 100 and positions on two opposing sides of the top cowling 40.

Figure 9:
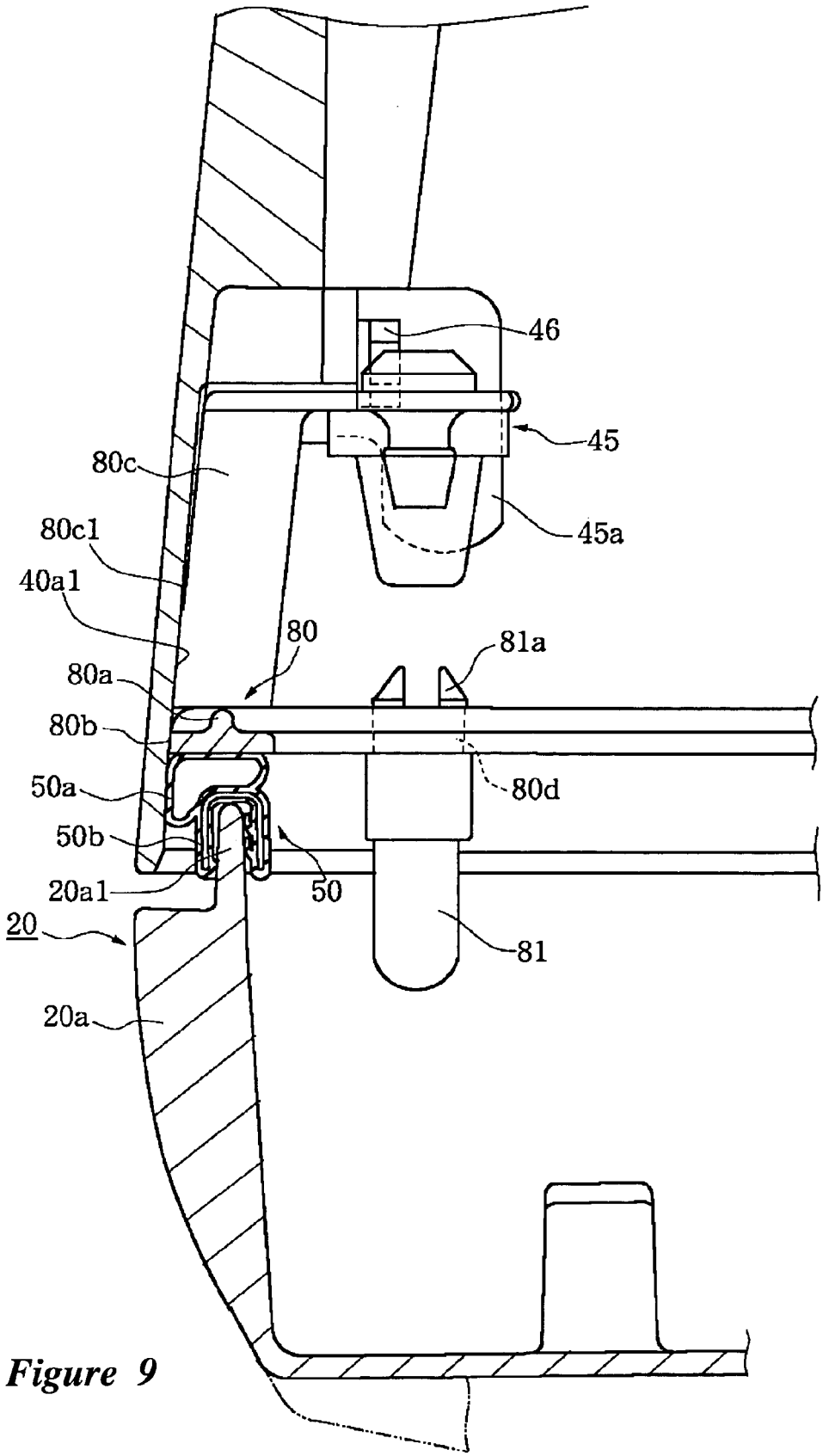
FIG. 9 is a partial sectional view illustrating the attached state of the top cowling and an annular rail according to an embodiment.
Figure 11:
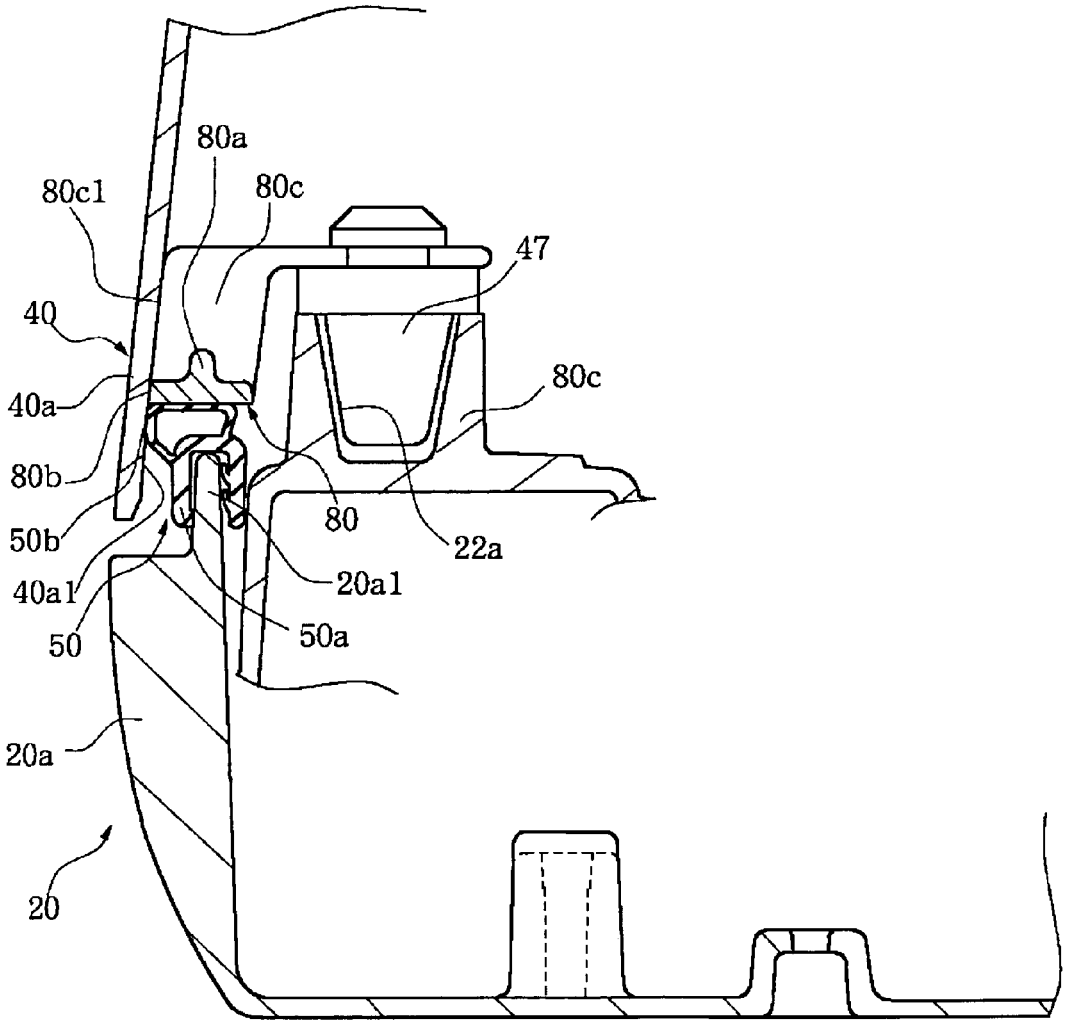
FIG. 11 is partial sectional view of a seal formed between the top cowling and the bottom cowling according to an embodiment of at least one invention described herein.
Figure 12:
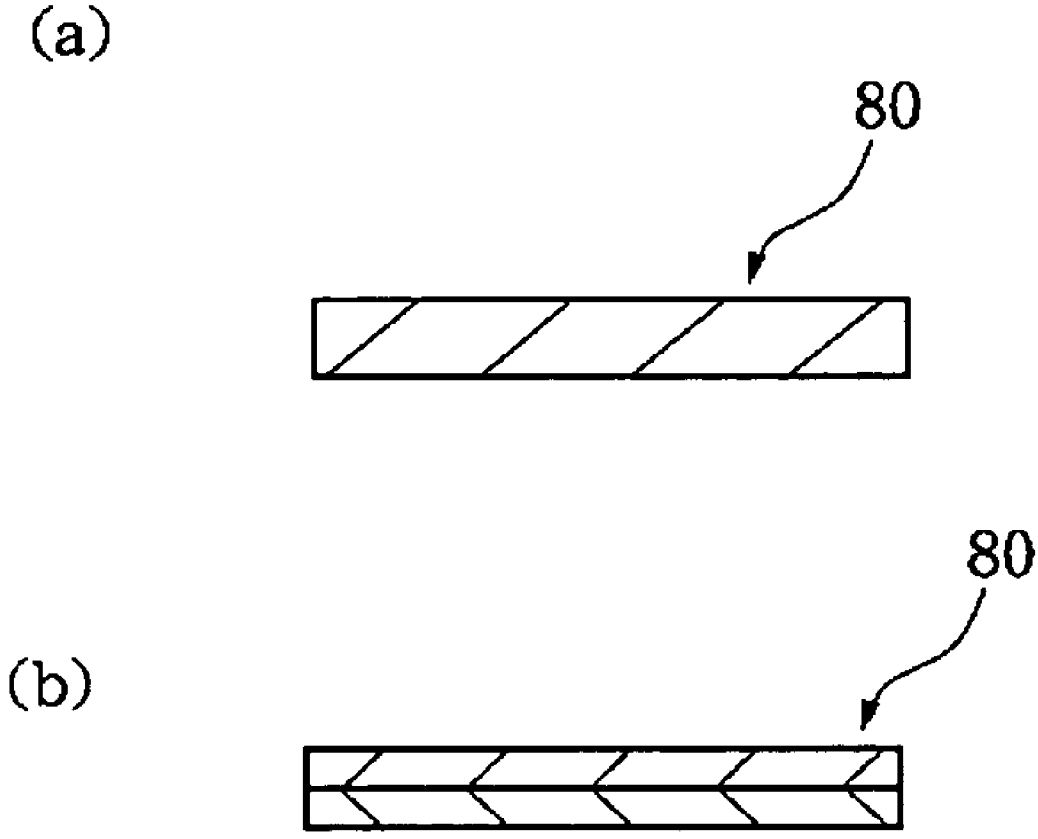
FIG. 12(*a*) and FIG. 12(*b*) are a cross-sectional views of modifications of the annular rail of FIG. 9.

As depicted in FIGS. 9 and 11, a ridge 80*a* is formed on at least one of the upper and lower sides of the annular rail 80 to increase the strength of the annular rail 80. In the embodiments depicted in FIGS. 9 and 11, the ridge 80*a* is formed the upper side of the annular rail 80. The ridge 80*a* can alternatively be formed on the lower side of the annular rail 80, or the annular rail 80 can have ridges on both sides. The annular rail 80 can be formed of a flat plate or formed by laminating a plurality of plates as shown in FIG. 12. In some embodiments, a metal, such as iron or SUS, is used as the material for forming the annular rail 80. In other embodiments, the annular rail 80 can be made from aluminum or another material.

As further shown in FIGS. 9 and 11, an attaching surface 80*b* of the annular rail 80 can be secured to the inner side 40*a*1 of the opening edge 40*a* of the top cowling 40 with an adhesive. Additionally, mounting bosses 80*c* formed on the annular rail 80 can be used to secure the annular rail 80 to the top cowling 40. More specifically, attaching surfaces 80*c*1 of the mounting bosses 80*c* can be secured to the inner side 40*a*1 of the opening edge 40*a* of the top cowling 40 with an adhesive. Thus, the annular rail 80 can be attached to the top cowling 40 easily and firmly.

A further advantage is achieved by forming the mounting bosses 80*c* monolithically with the rail 80. As such, the mounting bosses 80*c* and the rail 80 can be formed in a single manufacturing process. For example, the rail 80 and the mounting bosses 80*c* can be formed from a single piece of material, such as a metal, that has been stamped to cut and bend the metal into the final shape of the rail 80 having the mounting bosses 80*c* included therewith. Other stamping methods can also be used. The term "monolithic" is intended to mean a component or combination of components made from a single piece of material, such as that resulting from the stamping process described above, or from other methods such as casting.

An advantage of securing the attaching surfaces 80*b* and 80*c*1 of the annular rail 80 to the inner side 40*a*1 of the opening edge 40*a* of the top cowling 40 is the resulting reinforcement of the opening edge 40*a* and the enhanced mounting strength of the top cowling 40.

Figure 8:
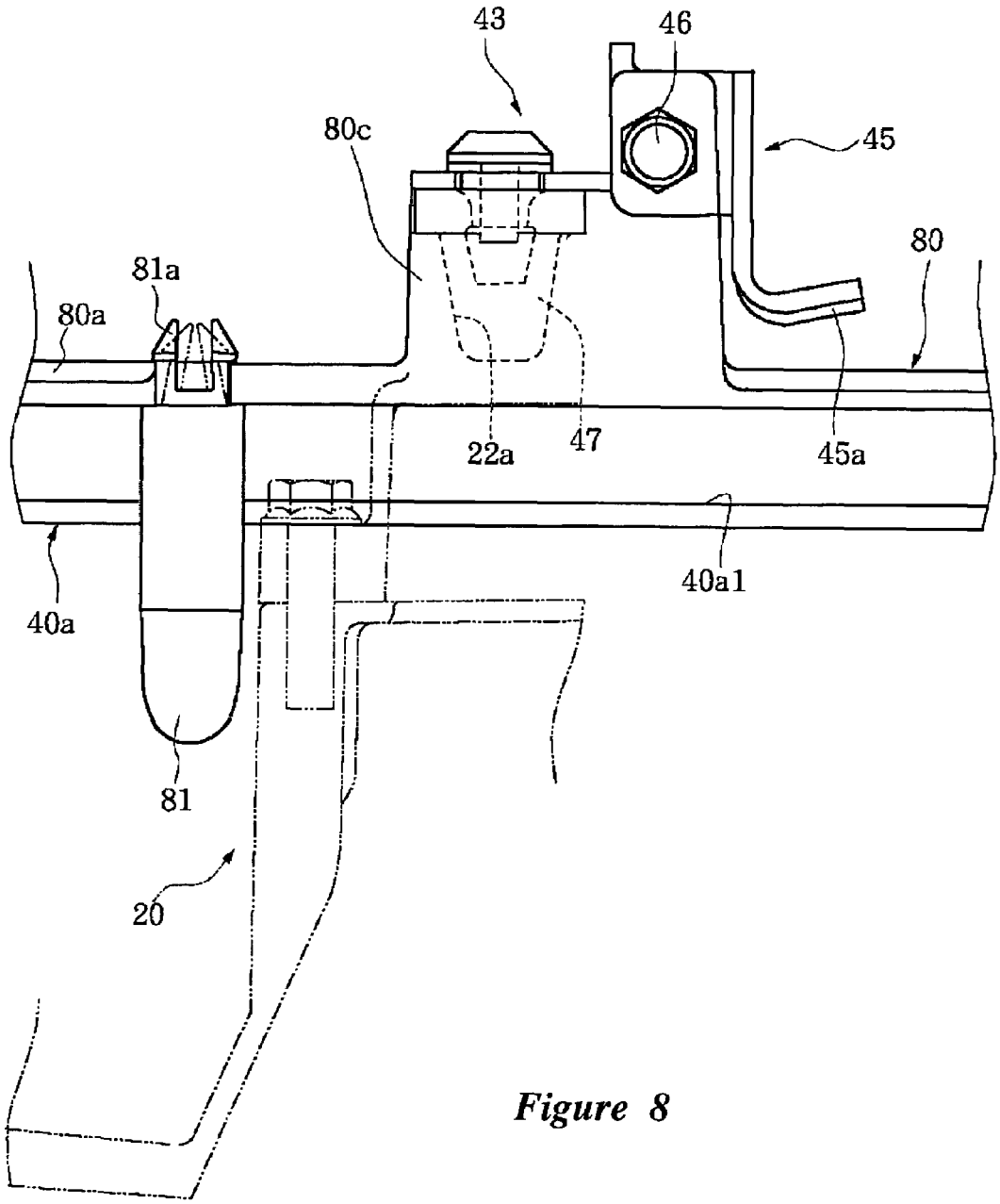
FIG. 8 is an elevational view of a top-side hook attached to the top cowling.
Figure 10:
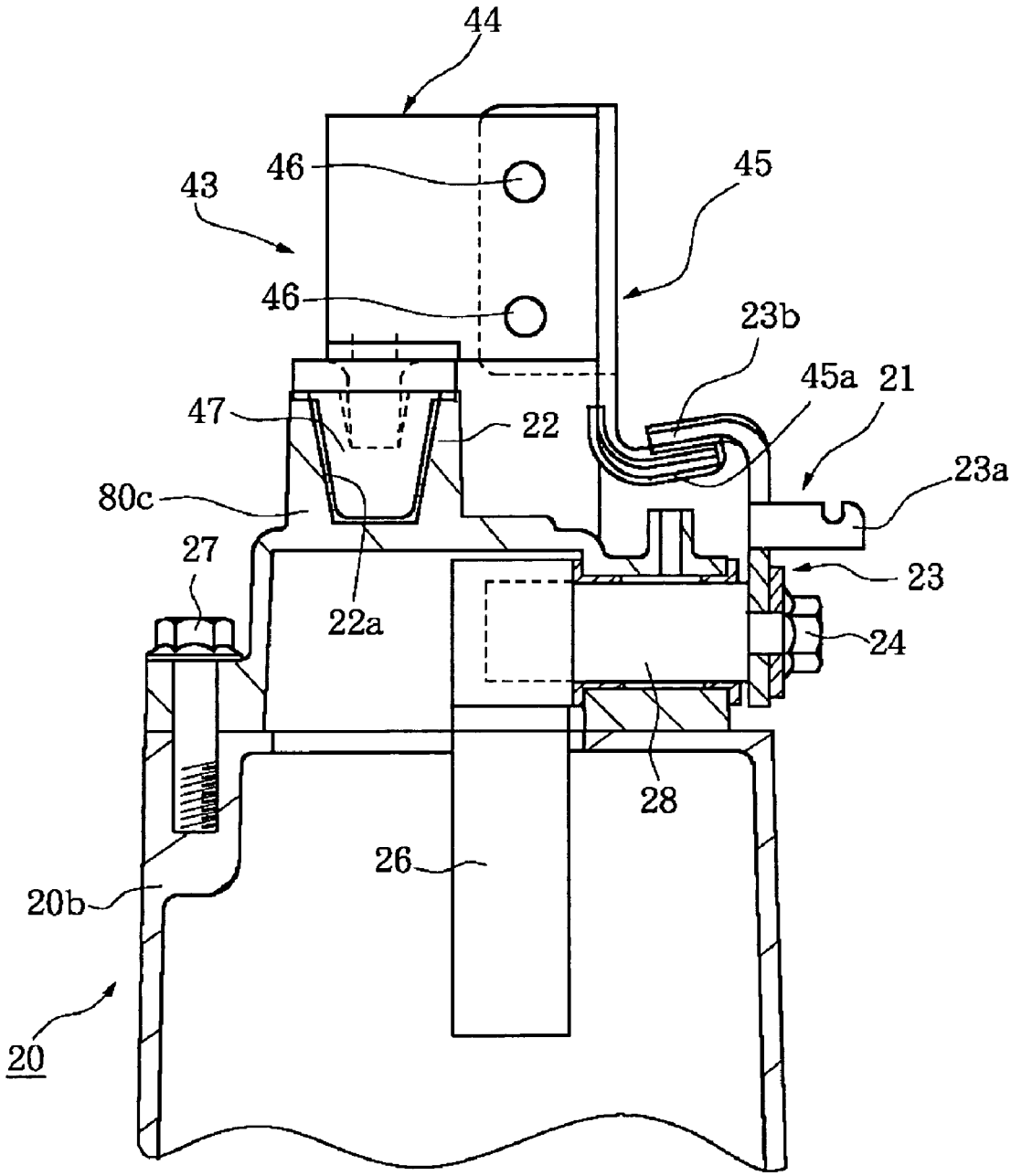
FIG. 10 is another partial sectional view illustrating the attached state of the top cowling and the bottom cowling.

With reference to FIGS. 8–10, each of the top-side attaching assemblies 43 can comprise a mounting boss 80*c*, a top-side hook 45, and a mounting bolt 46. In a preferred embodiment, the mounting bosses 80*c* are formed integrally with the annular rail 80, and the top-side hooks 45 are secured to the mounting bosses 80*c* by the mounting bolts 46. Since the top-side hooks 45 are attached to the mounting bosses 80*c*, which in turn are secured to the inside of the top cowling 40, the components of the top-side attaching assemblies 43 are not exposed to the outside of the top cowling 40 thereby protecting them from moisture, and the quality of appearance of the outboard motor is also enhanced.

Securing the annular rail 80 to the inside of the top cowling 40 or the mounting bosses 80*c* to the annular rail 80 can be effected using welding as an alternative to or in addition to using an adhesive. Also, since the top-side hooks 45 are attached to the annular rail 80 via the mounting bosses 80*c*, the top-side hooks 45 can be attached easily and can rely on the strength of the annular rail 80 to provide a firm attachment.

As shown in FIGS. 8 and 9, a leg member 81 is attached to the annular rail 80 such that it extends beyond the opening edge 40*a* of the top cowling 40. The leg member 81 is attached by inserting an engaging part 81*a* of the leg member 81 into a hole 80*d* of the annular rail 80 from below. (See FIG. 9) The leg member 81 can thus be easily and firmly attached, relying on the strength of the annular rail 80. Such leg members can be used to support the top cowling member 40 after being removed form the bottom cowling member 20 and placed on the ground with the opening edge 40*a* facing downwardly.

Also, since the mounting bosses 80*c* are bonded at a plurality of positions on the inner side 40*a*1 of the top cowling 40 and the annular rail 80 is secured to the mounting bosses 80*c*, the annular rail 80 is fixed firmly. This reinforces the opening edge 40*a* of the top cowling 40 and the mounting strength of the top cowling 40 is enhanced. The annular rail 80 can be secured to the mounting bosses 80*c* by any one of a variety of methods that are not specifically limited. For example, the annular rail 80 can be secured with an adhesive, by welding, or using bolts or screws.

With reference to FIG. 10, the top cowling 40 and the bottom cowling 20 are shown in a state of attachment to one another. To close the top cowling 40, engaging parts 45*a* of the top-side hooks 45 are pressed against the engaging parts 23*b* of the bottom-side hooks 23, thereby rotating the bottom-side hooks 23 against the springs 25. After the engaging parts 45*a* of the top-side hooks 45 have passed, the engaging parts 23*b* of the bottom-side hooks 23 are rotated by the springs 25 in the opposite direction to the original positions with the engaging parts 45*a* of the top-side hooks 45 below them, and the attached state shown in FIG. 10 is established.

As further depicted in FIG. 10, each of the mounting bosses 80*c* can include a positioning damper 47. When the top cowling 40 and the bottom cowling 20 are attached to each other, the positioning dampers 47 of the top-side attaching assemblies 43 are engaged with the positioning recesses 22*a* of the bottom-side attaching assemblies 21 to position the top cowling 40 and the bottom cowling 20 in a vertical direction.

When the top cowling 40 and the bottom cowling 20 are attached to one another, the seal member 50 provides a seal between the top cowling 40 and the bottom cowling 20 as shown in FIG. 11. The seal member 50 comprises an engaging part 50*a* and a seal part 50*b*. The seal member 50 can be attached to the bottom cowling 20 by engaging the engaging part 50*a* with the annular rib 20*a* 1 along the opening edge 20*a* of the bottom cowling 20, while the seal part 50*b* of the seal member 50 extends all along the opening edge 20*a*.

When the top cowling 40 and the bottom cowling 20 are attached to one another, the seal part 50*b* is compressed between a lower side of the annular rail 80 and the inner side 40*a* 1 of the opening edge 40*a* to provide a seal. In this embodiment, since a seal is formed by sealing surfaces extending in different directions, namely the annular rib 20*a* 1 formed along the opening edge 20*a* of the bottom cowling 20, the inner side 40*a* 1 of the opening edge 40*a*, and the annular rail 80 of the top cowling 40, a strong and effective seal can be formed.

Although this invention has been disclosed in the context of certain preferred embodiments, it will be understood by those skilled in the art that the present invention extends beyond the specifically disclosed embodiments to other alternative embodiments and/or uses of the invention and obvious modifications and equivalents thereof. It is also contemplated that various combinations or sub-combinations of the specific features and aspects of the embodiments can be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A cowling assembly for an outboard motor, comprising a top cowling and a bottom cowling for covering an internal combustion engine of the outboard motor:

wherein the top cowling comprises a first cowling portion configured to encircle an engine of the outboard motor, wherein the first portion is formed by pressing a single piece of nonferrous material;

wherein the top cowling comprises an annular rail that is secured to an inner side of an opening edge of the top cowling and that extends laterally inwardly from the inner side, thereby defining a flat downwardly facing surface, the flat downwardly facing surface contacting and forming a seal with the bottom cowling; and wherein mounting bosses are bonded at a plurality of positions on the inner side of the top cowling and the annular rail is secured to the mounting bosses.

2. A cowling assembly for an outboard motor, comprising a top cowling and a bottom cowling for covering an internal combustion engine of the outboard motor:

wherein the top cowling comprises a first cowling portion configured to encircle an engine of the outboard motor, wherein the first portion is formed by Dressing a single piece of nonferrous material;

wherein the top cowling comprises an annular rail that is secured to an inner side of an opening edge of the top cowling and that extends laterally inwardly from the inner side, thereby defining a flat downwardly facing surface, the flat downwardly facing surface contacting and forming a seal with the bottom cowling;

wherein the cowling assembly for an outboard motor further comprises a top-side hook attached to the annular rail, and a bottom-side hook attached to an opening edge of the bottom cowling, wherein the bottom-side hook is engaged with the top-side hook; and wherein mounting bosses are bonded at a plurality of positions on the inner side of the top cowling and the annular rail is secured to the mounting bosses.

3. A cowling assembly for an outboard motor, comprising a top cowling and a bottom cowling for covering an internal combustion engine of the outboard motor:

wherein the top cowling comprises a first cowling portion configured to encircle an engine of the outboard motor, wherein the first portion is formed by Dressing a single piece of nonferrous material;

wherein the top cowling comprises an annular rail that is secured to an inner side of an opening edge of the top cowling and that extends laterally inwardly from the inner side, thereby defining a flat downwardly facing surface, the flat downwardly facing surface contacting and forming a seal with the bottom cowling;

wherein a leg member extending downward beyond the opening edge of the top cowling is attached to the annular rail; and wherein mounting bosses are bonded at a plurality of positions on the inner side of the top cowling and the annular rail is secured to the mounting bosses.

4. A cowling assembly for an outboard motor, comprising a top cowling and a bottom cowling for covering an internal combustion engine of the outboard motor:

wherein the top cowling comprises a first cowling portion configured to encircle an engine of the outboard motor, wherein the first portion is formed by pressing a single piece of nonferrous material;

wherein the top cowling comprises an annular rail that is secured to an inner side of an opening edge of the top cowling and that extends laterally inwardly from the inner side, thereby defining a flat downwardly facing surface, the flat downwardly facing surface contacting and forming a seal with the bottom cowling;

wherein an annular rib is formed along the opening edge of the bottom cowling, and a seal is formed by the annular rib, the inner side of the opening edge and the annular rail of the top cowling; and wherein mounting bosses are bonded at a plurality of positions on the inner side of the top cowling and the annular rail is secured to the mounting bosses.

5. A cowling assembly for an outboard motor, comprising a top cowling and a bottom cowling for covering an internal combustion engine of the outboard motor:

wherein the top cowling comprises a first cowling portion configured to encircle an engine of the outboard motor, wherein the first portion is formed by pressing a single piece of nonferrous material;

wherein the top cowling comprises an annular rail secured to an inner side of an opening edge of the top cowling, the annular rail additionally comprising a mounting boss formed integrally on the annular rail, the mounting boss configured to support an anchoring hook that is configured to anchor the top cowling to the bottom cowling.

6. The cowling assembly for an outboard motor of claim 5, wherein the mounting boss is positioned so as to support the anchoring hook at a position recessed into the top cowling member.

7. A cowling assembly for an outboard motor, comprising a top cowling and a bottom cowling for covering an internal combustion engine of the outboard motor:

wherein the top cowling is formed by pressing a nonferrous material;

wherein the top cowling comprises an annular rail secured to an inner side of an opening edge of the top cowling:

wherein at least one mounting boss is attached to the inner side of the top cowling and the annular rail is supported by the at least one mounting boss; and wherein the at least one mounting boss supports at least one positioning damper that engages with a recess portion of the bottom cowling.

8. The cowling assembly of claim 7, wherein positioning damper and the recess portion define a vertical gap between the top cowling and the bottom cowling.

9. A cowling assembly for an outboard motor, comprising a ton cowling and a bottom cowling for covering an internal combustion engine of the outboard motor:

wherein the top cowling is formed by pressing a nonferrous material;

wherein the top cowling comprises an annular rail secured to an inner side of an opening edge of the top cowling; and wherein a leg member extending donwnward beyond the opening edge of the top cowling is attached to the annular rail by inserting an engaging part of the leg member into a hole in the annular rail.

10. The cowling assembly of claim 1, wherein at least one of the plurality of mounting bosses supports an anchoring hook that is configured to anchor the top cowling to the bottom cowling.

* * * * *

UNITED STATES PATENT AND TRADEMARK OFFICE

CERTIFICATE OF CORRECTION

PATENT NO. : 7,247,064 B2
APPLICATION NO. : 11/047516
DATED : July 24, 2007
INVENTOR(S) : Daisuke Nakamura It is certified that error appears in the above-identified patent and that said Letters Patent is hereby corrected as shown below:

On The Title Page Item (57) (Abstract), line 7, after "cowling" insert -- , --.

Column 2, line 44 (Approx.), delete "stem" and insert -- stern --, therefor.

Column 6, line 45, in Claim 2, delete "Dressing" and insert -- pressing --, therefor.

Column 6, line 66, in Claim 3, delete "Dressing" and insert -- pressing --, therefor.

Column 8, line 15, in Claim 7, delete "cowling:" and insert -- cowling; --, therefor.

Column 8, line 26, in Claim 9, delete "ton" and insert -- top --, therefor.

Column 8, line 33, in Claim 9, delete "donwnward" and insert -- downward --, therefor.

Signed and Sealed this

Eleventh Day of December, 2007

JON W. DUDAS
*Director of the United States Patent and Trademark Office*